United States Patent [19]

Weddendorf

[11] 4,007,810

[45] Feb. 15, 1977

[54] HEATER ASSEMBLY FOR A ROTATING CAFETERIA TYPE FOOD SERVICE COUNTER

[75] Inventor: Elmer R. Weddendorf, Cincinnati, Ohio

[73] Assignee: B/W Metals Company, Inc., Fairfield, Ohio

[22] Filed: Nov. 17, 1975

[21] Appl. No.: 632,459

[52] U.S. Cl. ..... 186/1 R; 126/261; 219/214; 312/236

[51] Int. Cl.[2] ..... E04H 3/04

[58] Field of Search ..... 186/1 R, 1 B, 1 D; 126/261, 268; 219/214, 354, 553, 386, 387, 389, 388, 388 C, 504, 511; 312/236

[56] References Cited

UNITED STATES PATENTS

| | | | |
|---|---|---|---|
| 3,025,379 | 3/1962 | Ford | 219/354 |
| 3,120,599 | 2/1964 | Hilgers | 219/214 |
| 3,391,758 | 7/1968 | Kinkaid | 186/1 R |
| 3,586,823 | 6/1971 | Schier | 219/354 |

*Primary Examiner*—Trygve M. Blix
*Assistant Examiner*—Reinhard J. Eisenzopf
*Attorney, Agent, or Firm*—Wood, Herron & Evans

[57] ABSTRACT

An improved overhead heater assembly fixed to a rotating cafeteria type food service counter. The improved heater assembly includes infrared type radiant heater rod elements disposed concentrically above the counter's hot food section, the number of heater rods provided being equal to the number of step sections in the counter's hot food section. The heater rods are combined with radiant heat reflectors and heater switches in a single hood unit that permits varying the heat between the inner periphery and the outer periphery of the rotating counter as desired by an operator. Light bulbs interposed between at least two of the heater rods serve to illuminate the food positioned in the counter's hot food section.

7 Claims, 4 Drawing Figures

HEATER ASSEMBLY FOR A ROTATING CAFETERIA TYPE FOOD SERVICE COUNTER

This invention relates to food service counters. More particularly, this invention relates to an improved overhead heater assembly for a food service counter of the rotating cafeteria type.

Over the years the cafeteria style of serving food has been one of the mainstays of the food service industry. This particular style of distributing food to the consumer has been found particularly effective in connection with institutional type feeding such as commonly is found in schools, hospitals and the like. The cafeteria type food service facility is also quite popular with large corporations in connection with the feeding of employees at lunchtime. Of course, the cafeteria style food distribution system has also been used over many years in retail restaurant installations. All such food service facilities are commonly known as cafeterias.

Historically, the food service counters in cafeteria style food service operations have been substantially planar, i.e., the counter has been of a flat, table-like configuration. Prepared food of each individual food dish is placed on the counter in dish rows extending from the front edge to the rear edge of the counter, the dishes of food in each row being the same, e.g., the same salad or same dessert or the like. The customer's tray is supported on a tray support that is fixed to the counter along the front edge thereof, and extends outwardly therefrom. In use, a customer walks from one end of the food service counter to the other, making periodic selections of different food dishes along the way. As the customer moves from one end of the counter to the other he pushes the tray on the tray support in front of him, and places his food selections on his tray.

In recent years there has been developed a new type cafeteria counter that is configured in the shape of a doughnut. The doughnut-shaped counter rotates about a center axis at a relatively slow rate. The counter rotates between a kitchen or food supply area and a customer service area, the kitchen and customer service areas being separated one from the other by a wall or other suitable divider. The counter's food supply is replenished by employees within the kitchen area, and the dished food is selected and removed from the counter by customers standing within the customer service area. A series of tray supports are disposed about the circular outer periphery of the rotating counter in the customer service area. The tray supports are stationary and are fixed to a stationary exterior wall within which the counter rotates, thereby defining fixed stalls within which the customers stand as the food counter (with dished food thereon) rotates past each stall for selection or rejection by the customer within the stall. Typical patents illustrating this general structure, and specific features of this general structure, are U.S. Pat. Nos. 2,968,363, 3,298,461, 3,391,758, 3,841,440, 3,847,250 and 3,872,801.

The rotating cafeteria food service counter is becoming popular today particularly with institutional and in-plant type facilities. This for one reason that the rotating style food service type counter does not require the customer to walk the length of the counter available for customer service. On the contrary, the customer stands completely still while the food dishes move to the customer in sight and within easy reach. It has been found that the method of serving food by a rotating food service counter provides fast service, requires less customer service area, reduces mechanical installation costs, and provides an efficient use of labor relative to the historical cafeteria style food service counter in which the customer walked from one end of the counter to the other.

There are, basically, three different sections in each food service counter of the rotating cafeteria type. The three sections are primarily differentiated one from the other by the temperature of the foods positioned on the food service counter within that section. The three sections are a hot section, a cold section, and a room temperature section. Of course, the hot section is heated by suitable heating means incorporated in the rotating counter to provide hot foods to the customer such as, e.g., hot entrees, hot vegetables, and the like. The cold section is cooled by suitable cooling means incorporated in the rotating counter to provide cold foods to the customer such as, e.g., salads, and the like. The room temperature food section is, of course, that section at which foods are presented for the customer's review which need neither heating nor cooling to maintain same fresh on the counter; such foods include, e.g., sandwiches, desserts, and the like.

This invention is directed to an improved overhead heater assembly particularly adapted to keep hot foods in a hot condition while same are presented on the rotating cafeteria type food service counter's hot section for selection by the customer, and prior to selection by the customer. Because of the various types of hot foods which the rotating counter must be adapted to serve at, e.g., breakfast, lunch and dinner, and because the counter is generally provided with a series of, for example, three steps within the hot section so as to present predished foods in a visually attractive manner to the customer, it is desirable to provide an improved overhead radiant heater assembly structure which permits the radiant heat on the first and second steps, i.e., on the outer peripheral step levels, of the rotating counter's hot section to be varied as desired by the machine's operator. Also, it is desirable to provide a visible light source within the overhead heater assembly itself so that the food is sufficiently lighted for clear observation by the customer.

Accordingly, it is the primary objective of this invention to provide an improved overhead heater assembly for a rotating cafeteria type food service counter where the heater assembly is in the form of a unitary structure that incorporates both infrared radiant heater elements and light source elements.

It has been another objective of this invention to provide an improved heater assembly such as described in the paragraph immediately above which incorporates switch circuitry, and in which the radiant heater elements are specifically oriented relative to a three-step cafeteria counter structure, to permit variation within limits of the quantum of radiant heat provided on the middle step and at least a portion of the first step as desired by the counter's operator.

In accord with these objectives, the improved overhead heater assembly of this invention is for use with a rotating cafeteria type food service counter. The improved heater assembly, in preferred form, includes infrared type radiant heater rod elements disposed concentrically above the counter's hot food section, the number of heater rods provided being equal to the number of step sections in the counter's hot food section. The heater rods are combined with radiant heat reflectors and heater switches in a single hood unit that permits varying the heat between the inner periphery and the outer periphery of the rotating counter as desired by an operator. Light bulbs interposed between at least two of the heater rods serve to illuminate the food positioned on the counter's hot food section.

Other objectives and advantages of this invention will be more apparent from the following detailed description taken in conjunction with the drawings in which:

FIG. 3 is a bottom view of the improved overhead heater assembly itself as taken along line 3—3 of FIG. 2.

Figure 1:
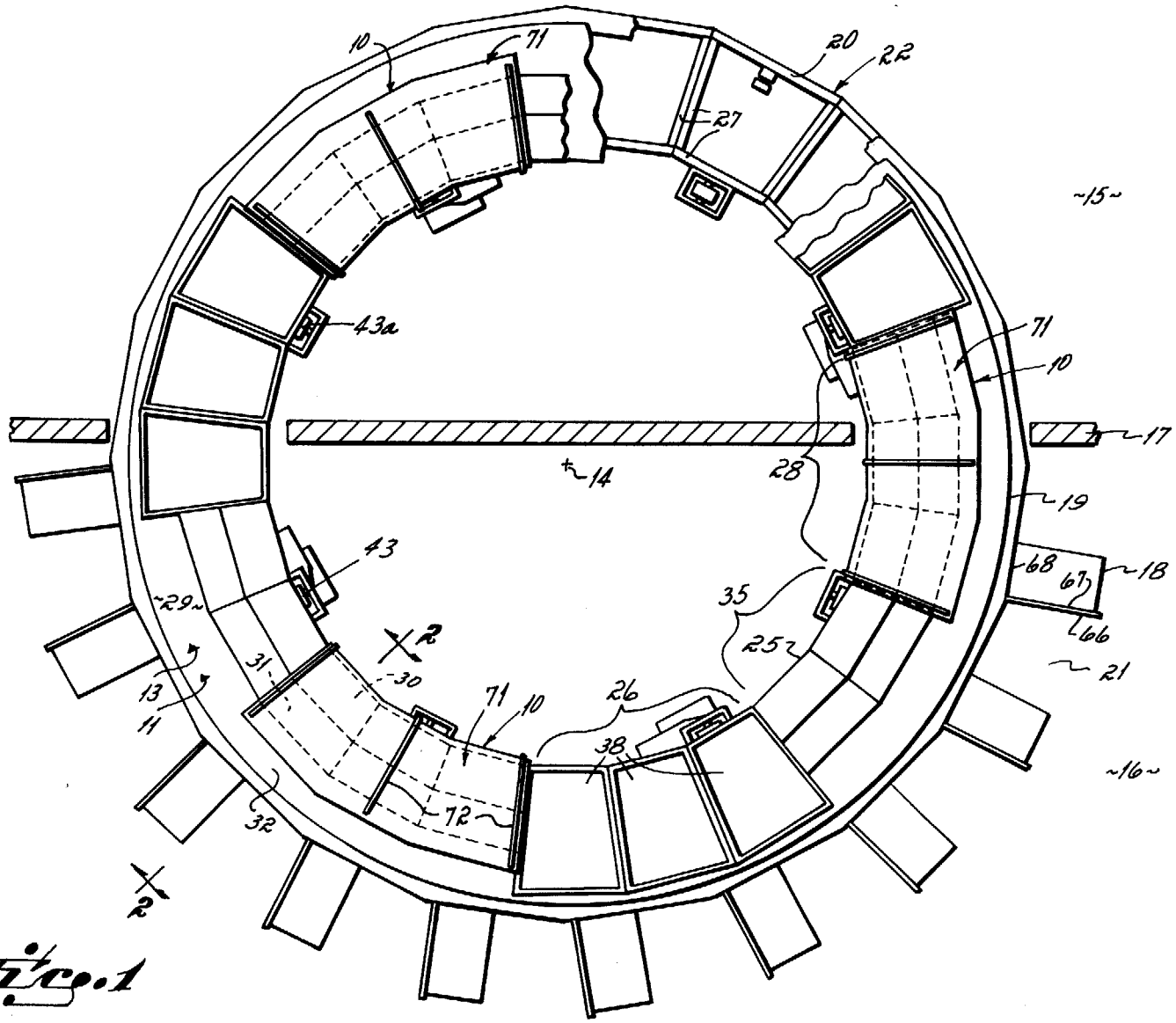
FIG. 1 is a top view of a rotating cafeteria type food service counter showing location of the improved overhead heater assembly of this invention.

The novel and improved heater assembly 10 of this invention is incorporated with a rotating cafeteria style food service counter 11 having a horizontal, doughnut-shaped counter top 13 adapted to rotate about a center axis 14. The counter top 13 rotates between a kitchen or food supply area 15, and a customer service area 16. The kitchen 15 and customer service 16 areas are separated one from the other by a wall 17 or other suitable divider. The counter's food supply is replenished by employees within the kitchen area 15, and the food is selected and removed from the counter top 13 by customers standing within the customer service area 16.

A series of tray supports 18 are disposed about the circular outer periphery 19 of the rotating counter top 13 in the customer service area 16. The tray supports 18 are stationary, and are fixed to a stationary exterior wall 20 within which the counter top 13 rotates, thereby defining fixed stalls 21 within which the customers stand as the food counter top (with food thereon) rotates past each stall for selection or rejection by the customer within the stall.

More particularly, the rotating counter 11 includes a stationary frame 22 comprised of a series of vertical posts or uprights 23 (which define a circle) disposed about the circular periphery 19 of the counter top 13 and which terminate at their lower ends in legs or feet **23*a*, and a series of vertical posts or uprights 24 (which define a circle) disposed adjacent the circular inner periphery 25 of the counter top 13 and also which terminate at their lower ends in legs or feet 24*a*. These posts 23, 24 are disposed in pairs, each pair being tied together by a cross member 27. The outer wall 20 is fixed to the outer posts 23, thereby providing a closed frame 22 or base structure which lends to the appearance of the rotating counter 11** from an aesthetic standpoint.

The rotating counter top 13 includes a horizontally disposed doughnut-shaped table 29 having a circular front edge and a circular rear edge that correspond, respectively, to outer 19 and inner 25 peripheries. The counter top 13 is supported by the frame 22, and is rotated by drive means fixed to the frame and described in detail below. As illustrated in FIG. 1, the counter top 13 is symmetrically divided into three separate sets of food serving sections 26, 28, 35, section 26 being for cold food, section 28 being for hot food and section 35 for room temperature food. The top 13 is provided, in each of the hot food 28 and room temperature food 35 sections of its circumference, with two steps 30, 31 adjacent the rear edge 25 thereof, thereby dividing the width of the table 29 in those portions into three separate, concentric food display areas 32–34 raised one above the other in step-like sequence, i.e., an outer section 32, a center section 33, and an inner section 34. Each cold food section 26 is provided with sloped trays 38 that sit on the table 29 which is flat, i.e., without steps, in that cold food section. The three sloped trays 38 shown in each cold section 26 may be provided with ice to hold cold dishes such as salads and the like. Of course, the step-like hot food section 28 of the round counter may be provided with predished hot food. The counter top 13 also includes a depending flange 40 adjacent to and concentric with its outer periphery 19, and a depending L-shaped keel 41 adjacent to and concentric with its inner periphery 25, the flange and keel elements cooperating with the counter's drive mechanism to rotate same during operation thereof.

The drive system for this counter 11 is particularly described in U.S. Pat. No. 3,872,801. Generally speaking, the counter top 13 essentially rests on a series of idler wheels 42 disposed about its outer periphery 19, and a plurality of drive 43 and idler **43*a* wheels disposed about its inner periphery 25, see FIG. 1. The idler wheels 42 disposed about the counter top's outer periphery 19 are simply wheels mounted in bearings 36, the bearings being fixed to the posts 23 of the counter's frame 22 by bolts 44, see FIG. 2. The drive wheel 43 mechanism is also fixed to the counter's frame 22, but is fixed on an inner post 24 thereof. Each drive wheel 43 mechanism includes the drive wheel that is carried in bearings 45, the bearings being mounted on a plate 46 fixed to extend horizontally from an inner peripheral post 24 (the plate 46 is reinforced by gusset bar 47). The drive wheel's shaft 48 is provided with a pulley 49 on its inner end, the pulley being connected with pulley 50 of a drive motor 51 by belt 52. The motor 51 is mounted on a table 53 also fixed to the frame 22, that table 53 being reinforced by gusset plate 54. The idler wheels 43*a*, which are similar to drive wheels 43, are mounted to other inner posts 24 to provide adequate support for the counter top 13 on its inner periphery 25. Since the L-shaped inner annular keel 41 is frictionally engaged with the drive wheel 43, rotation of the drive wheel at a controlled speed causes the counter top 13** to rotate at a controlled speed also.

Figure 2:
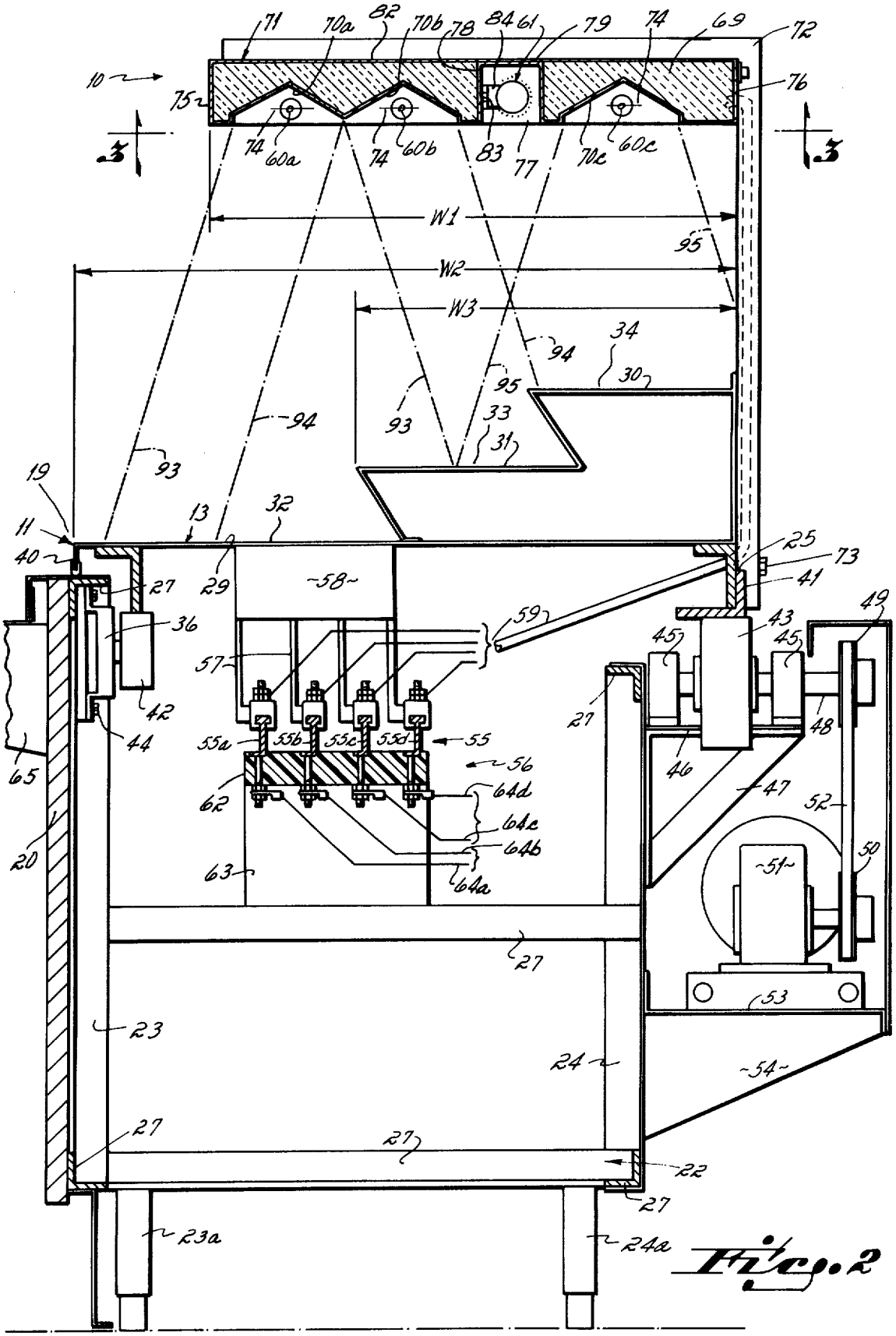
FIG. 2 is a cross-sectional view of the rotating cafeteria type food service counter taken along line 2—2 of FIG. 1.
Figure 5:
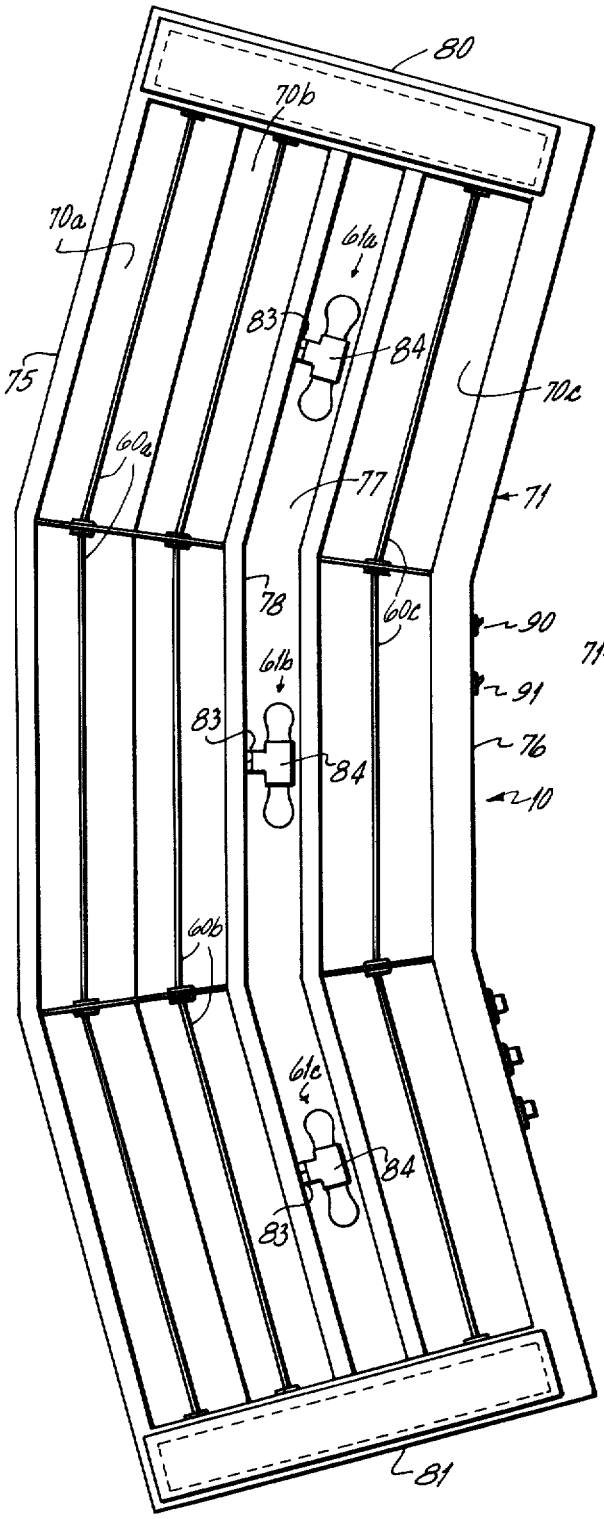

Electric power to the overhead heater assembly 10, which is fixed in place on the counter top 13, is provided by a series of circular busbars 55 and trolleys 56 disposed beneath that counter top. As shown in FIG. 2, four circular busbars 55 are mounted concentrically, through insulator arms 57, to a series of support brackets 58 spaced around the counter top and fixed to the underside of that counter top. These circular busbar tracks are connected by suitable wiring 59 to the overhead heater assembly 10, two of those busbars **55*a*, 55*b* being provided to power the heater assembly's infrared heater elements 60 and two of these busbars 55*c*, 55*d* being provided to power the heater assembly's lighting elements 61. Electric power to the busbars is transmitted by a series of four trolleys 56, one for each busbar track. The trolleys 56 are fixed in place beneath the circular tracks 55 and are adapted to engage those circular track busbars. Each trolley 56 is fixed in a common insulative block 62 which is mounted to the counter frame 22 by common bracket 63. The trolleys 56 are electrically connected by suitable wiring 64 (leads 64***a*, 64*b* for the radiant heating elements 60, and leads 64*c*, 64*d* for the lighting elements 61) to a power source, not shown.

A series of tray supports 18 are disposed about the outer periphery 19 of the counter 11, and fixed to the wall 20, in the customer service area 16 of the counter. The tray supports 18 are simply horizontally disposed plates adapted to receive the cafeteria tray of the customer, each support being fixed to the counter's wall by a suitable bracket 65. A vertical stall wall 66 disposed radially relative to the counter is interconnected with each tray support 18 on one side thereof as at 67, and to the counter's peripheral wall 28, as at 68. The tray supports 18, and vertical radially disposed stall walls 66 associated therewith, cooperate to define the series of stalls 21 disposed about the outer periphery 19 of the counter within the customer service area 16, each stall being sized to accommodate one customer at a time.

Figure 4:
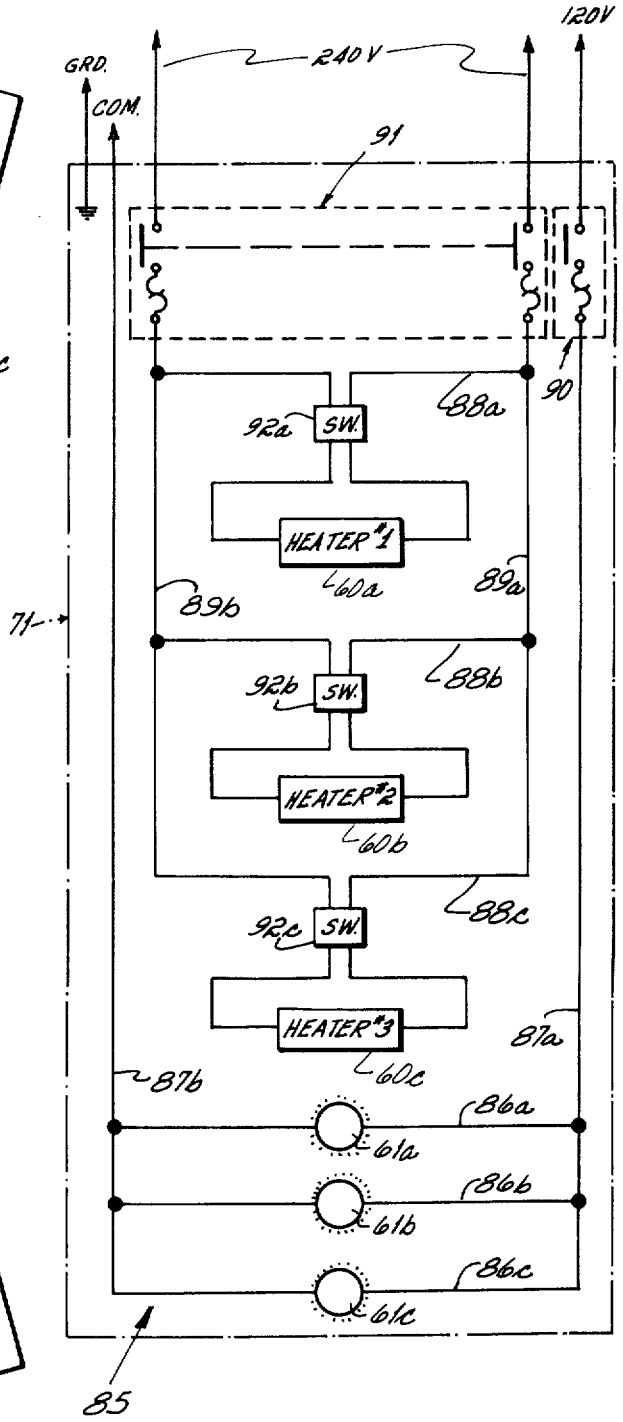
FIG. 4 is a circuit drawing illustrating the switch control circuitry of the improved overhead heater assembly of this invention.

The improved overhead heater assembly 10 of this invention is particularly illustrated in FIGS. 2 and 3, and the electrical circuitry for that heater assembly is set out in FIG. 4. As shown in FIGS. 2 and 3, the overhead heater assembly 10 basically includes an overhead section 71 that extends from one end to the other of that stepped section 32–34 adapted to receive hot foods, i.e., in the counter's hot food section 28. The width W1 of the heater's overhead section 71 is less than the radial width W2 doughnut-shaped counter, but is greater than the combined radial width W3 of the center step 33 and inner step 34 sections of the counter. This dimensional relationship of the heater assembly's overhead section 71 to the outer 32, center 33 and inner 34 step sections of the counter is important vis-a-vis the radiant heat output of the heat rod elements 60 carried in the overhead section 71. The overhead section 71 is fixed to, and is elevated above, the rotating counter top 13 by means of support arms 72 bolted as at 73 to the L-shaped keel 41 of the counter, three such arms being equally spaced along the length of the unitary heater assembly as shown in FIG. 1.

The overhead section 71 of the improved heater assembly 10, as illustrated in FIGS. 2 and 3, is comprised of three separate infrared heater rod elements 60*a*, 60*b*, 60*c* which are concentrically disposed relative to the center axis 14 of the rotating food service counter. Each heater rod element 60 may be a tubular radiant heater of the type sold under the CHROMALOX trademark by Edwin L. Wiegand Division, Emerson Electric Co., 3500 Thomas Boulevard, Pittsburgh, Pa. 15208. Each of the radiant heater rod elements 60 is disposed in an inverted V-shaped reflector channel section 70*a*, 70*b*, 70*c*. The reflective sheeting used to define the inverted V-shaped reflector channels, which channels also extend from one end 80 of the unitary heater assembly 10 to the other end 81, is preferably fabricated of an aluminum reflector material that is particularly adapted to reflect infrared heat. The infrared heater rod elements 60*a*, 60*b* that serve the outer 32 and center 33 step sections of the food service counter are disposed in parallel juxtaposition one to the other in a horizontal plane 74 toward the outer periphery 75 of the overhead section 71. The infrared heater rod element 60*c* that serves the inner step section 34 is disposed in parallelism with those rod elements 60*a*, 60*b*, and in the same horizontal plane 74 as those elements but is positioned in juxtaposition to the inner periphery 76 of the heater assembly's overhead section 71. The heater rod elements 60*a*, 60*b* and the heater rod element 60*c*, are separated one from the other within the unitary overhead section 71 by channel 77 for the light bulbs 61. The light channel 77 is defined by an inverted U-shaped channel section 78 fixed to outer casing 82 of the overhead section 71 as at 79, same defining an opening from one end 80 to the other 81 of the heater assembly's overhead section. Light bulb sockets 84 for the light bulbs 61 are fixed, as at 83, to one side wall of the inverted U-shaped channel section 78. The light bulb channel 77 is provided intermediate the heater rod elements 60*b* and 60*c* that primarily serve the center 33 and inner 34 step sections so as to provide adequate illumination on the food disposed on those step sections to a customer making use of the rotating food service counter. The overhead section's casing 82 defines the top and side wall faces of that section 71, and the reflector channel sections 70 and light channel section 78 defines the bottom wall face of that section. Insulation 69 is interposed within the overhead section 71 between the reflector channel sections 70 and the casing 82 to reduce the casing's temperature during operation of the unit.

The electrical circuitry 85 for the improved overhead heater assembly 10 of this invention is particularly illustrated in FIG. 4. As shown in that Figure, the light elements 61 are mounted in parallel on lines 86*a*, 86*b*, 86*c* in a first circuit 87*a*, 87*b*, and the infrared heater rod elements 60 are mounted in parallel on lines 88*a*, 88*b*, 88*c* in a second circuit 89*a*, 89*b*, both circuits 87, 89 being connected with the respective busbars 55 through lead 59 and, thence, to the power source. The electric light bulb circuit 87 is controlled by a single breaker switch 90 located on the inner edge 76 of the heater assembly 10 as shown in FIG. 3. The three rod-like heater elements 60 are likewise controlled by a single breaker switch 91 located on the rear edge 76 of the heater assembly 10. However, and importantly, each of the heater rod elements 60*a*, 60*b*, 60*c* is provided with a separate control switch 92*a*, 92*b*, 92*c*, respectively, in the respective parallel line 88*a*, 88*b*,88*c*that interconnects between lines 89*a*, 89*b* which define the circuit 89. The separate control switch 92 for each heater rod element 60 permits the operator to vary the heat provided within the hot food section 28 in a given sequence as desired, and depending on the foods present in that hot food section, as is described in detail below.

The general operation of a rotating cafeteria type food service counter is described in the patents referred to heretofore in this specification. The use of the improved heater assembly 10 of this invention on such a rotating cafeteria type food service counter is continuous in that the heater assembly is fixed to the rotating counter table 13, thereby rotating along with the counter 11 and maintaining its fixed position relative to a hot food section(s) 28 of the counter. Power for the infrared heater rod elements 60, and for the light bulbs 61, is transmitted from a power source, not shown, through trolley 56/busbar track 55 and cable 59, 64 structure to the unitary overhead heater assembly 10 as the counter top 13 rotates.

In use, the operation of the overhead heater assembly 10 is dependent on the desires of the operator as dictated by the type of food in the hot food section 28, and/or the number of step sections 32–34 in use within the hot food section (i.e., the load or amount of hot food in the hot food section). As illustrated particularly in FIG. 2, the front heating rod element 60*a* relative to the outer periphery 75 of the overhead heater assembly 10 is positioned, and the inverted V-shaped reflector channel 70*a* is configured, to focus heat (as shown by phantom lines 93) onto the entire of the outer step section 32 and the front half of the center step section 33. The center heating rod element 60*b* is positioned, and the inverted V-shaped reflector channel 70*b*is configured, to focus heat (as shown by phantom lines 94) onto the inner or rear half of the outer step section 32 as well as the entire of the center step section 33. The inner heater rod element 60*c* is positioned, and the inverted V-shaped reflector channel is configured, to focus heat (as shown by phantom lines 95) onto the rear or inner half of the center step section 33 as well as the entire of the inner step section 34. Upon commencing use of the rotating counter 11, the two master circuit breakers, one 90 for the light bulbs 61 and the other 91 for the radiant heater rod elements 60 are switched on, thereby turning the light bulbs on and activating the heater rod circuitry. The three individual heater rod switches 92*a*, 92*b*, 92*c* may then be manipulated as desired by the operator so as to provide any combination of focused heat 93–95 on any one or more of the three step sections 32–34 which make up the counter's hot food section 28. For example, and under certain use conditions, it may be desirable that the extra heat provided by heater rod element 60*b* to the center step section 33 is not required. If such is not required, the focused heat 93, 95 from the outer heater rod element 60*a* and from the inner heater rod element 60*b* will still bathe all three step sections 32–34 in infrared radiant heat. In other words, the second heater rod element 60*b* may be used to increase or decrease the infrared heat focused on the entire of the center step section 33, and the rear half of the outer step section 32. Thus, foods needed to be kept particularly hot may be placed on the center step section 33 or on the rear half of the outer step section 32, as those areas are provided with overlapping and double infrared focused heat from the outer 60*a* and center 60*b* heater rod elements. As a further example, and during periods of light customer use, the inner heater rod element 60*c* might be turned off all together if the inner step section 34 is not needed because of low customer use. In such a situation, the outer 60*a* and center 60*b* heater rod elements would suffice to bathe the outer 32 and center 33 step sections in adequate infrared reflected heat, thereby keeping the foods positioned on those step sections hot for the customer.

Having described in detail the preferred embodiment of my invention, what I desire to claim and protect by Letters Patent is:

1. A rotating cafeteria type food service counter apparatus having an improved overhead heater assembly, said apparatus comprising a generally circular food service counter adapted to rotate about a fixed center axis, said counter including a counter top adapted to receive food in a hot food section;

at least two step sections provided on said counter top in said hot food section, a plurality of infrared type radiant heater rod elements disposed generally concentrically relative to said fixed center axis above said hot food section, the number of said heater rod elements being at least equal to the number of step sections in said hot food section, and each of said rod elements extending from one end to the other of said hot food section, a plurality of radiant heat reflectors, one of said radiant heat reflectors being positioned above each of said heater rod elements to direct the radiant heat onto said step sections, at least two of said radiant heat reflectors being configured to focus radiant heat on the same portion of said counter top, at least one light bulb adapted to illuminate the food in said hot food section, said light bulb being positioned in a light bulb channel interposed between two of said concentric heater rod elements, said light bulb being separately controlled relative to said heater rod elements, said heater rod elements, heat reflectors and light bulb being combined in a single overhead unit, a separate control switch in an electric circuit for each of said heater rod elements, said separate control switches permitting each of said heater rod elements to be energized as desired by an operator to vary the amount of radiant heat focused on different portions of said hot food section, and structural arm means connecting said overhead unit and said counter top.

2. An improved overhead heater assembly as set forth in claim 1 wherein said separate control switches are located on the inner edge of said single overhead unit.

3. An improved overhead heater assembly as set forth in claim 1 wherein said heater rod elements are in the same horizontal plane.

4. An improved overhead heater assembly as set forth in claim 3 wherein said overhead unit is of a generally planar configuration and is oriented generally horizontal to said counter top.

5. An improved overhead heater assembly as set forth in claim 1 wherein the number of step sections is three, wherein said outer heater rod element and said outer reflector channel are positioned and configured to focus heat on said outer step section and about one-half of said center step section, wherein said center heater rod element and said center reflector section are positioned and configured to focus heat on the inner one-half of said outer step section and the entire of said center step section, and wherein said inner heater rod element and said inner reflector section are positioned and configured to focus heat on the inner one-half of said center step section and the entire of said inner step section.

6. An improved overhead heater assembly as set forth in claim 5;

wherein said light bulb channel is disposed between the inner of said heater rod elements and the center of said heater rod elements.

7. A rotating cafeteria type food service counter apparatus having an improved overhead heater assembly, said apparatus comprising a generally circular food service counter adapted to rotate about a fixed center axis, said counter including a counter top adapted to receive food in a hot food section;

at least two step sections provided on said counter top in said hot food section, a plurality of infrared type radiant heater rod elements disposed generally concentrically relative to said fixed center axis above said hot food section, the number of said heater rod elements being at least equal to the number of step sections in said hot food section, and each of said rod elements extending from one end to the other of said hot food section, a plurality of radiant heat reflectors, one of said radiant heat reflectors being positioned above each of said heater rod elements to direct the radiant heat onto said step sections, at least two of said radiant heat reflectors being configured to focus radiant heat on the same portion of said counter top, said heater rod elements and heat reflectors being combined in a single overhead unit, a separate control switch in an electric circuit for each of said heater rod elements, said separate control switches permitting each of said heater rod elements to be energized as desired by an operator to vary the amount of radiant heat focused on different portions of said hot food section, and structural arm means connecting said overhead unit and said counter top.

* * * * *